United States Patent [19]

Izzo

[11] 4,327,663

[45] May 4, 1982

[54] DOOR KNOB SHIELD

[76] Inventor: Michael J. Izzo, P.O. Box 1125, Homestead, Fla. 33030

[21] Appl. No.: 179,108

[22] Filed: Aug. 18, 1980

[51] Int. Cl.[3] ..... B05C 21/00

[52] U.S. Cl. ..... 118/505; 15/257 R

[58] Field of Search ..... 15/104 R, 248, 257 R; 4/255; 30/130, 301, 316; 118/504, 505; 51/310, 311

[56] References Cited

U.S. PATENT DOCUMENTS 2,925,064 2/1960 Kahn ..... 118/505

FOREIGN PATENT DOCUMENTS 563251 6/1975 Switzerland ..... 118/504

*Primary Examiner*—Edward L. Roberts

*Attorney, Agent, or Firm*—John Cyril Malloy

[57] ABSTRACT

A door knob shield for use in painting a door; the tool is composed of an elongate handle having a skirt coaxially arranged and secured to one end of said handle; the skirt which has an open end is sized to be positioned over a door knob with the terminal end of the skirt positioned in abutting relation to a door with the skirt jacketing the door knob nested within the skirt so that the zone of the door about the door knob may be painted rapidly without masking tape to avoid the problem of partially painting the door knob base.

2 Claims, 4 Drawing Figures

DOOR KNOB SHIELD

FIELD OF THE INVENTION

This invention relates to a painter's tool and more particularly to a door knob shield for use by a painter in readily and quickly painting a door zone about a door knob.

BACKGROUND OF THE INVENTION

In the past there has been a problem often encountered by painters painting a building where there are numerous doors. Because door handles are ordinarily of a different material than is the door, it is necessary to, first, mask around a door knob or, alternatively to paint about it very carefully and hence slowly so as to define precisely and neatly the line between the door knob base and the door. This invention is of a shield which includes a handle extending from a coaxial skirt which is sized to nestingly receive the door knob with the skirt end in close abutting relation to the door at the base of the door knob so that paint may be applied to the door about the base of the door knob without getting paint on the door knob. By using the tool painting of a door can take place quickly and without the attendant labor of prior art techniques.

OBJECTS OF THE INVENTION

It is an object of this invention to provide an improved door knob shield for use by painters in quickly and readily painting about a door zone adjacent a door knob and which is composed of a handle with a coaxial skirt sized to receive the door knob and with the skirt being adapted to abuttingly engage the door about the door knob and which tool may include inserts to accommodate various size of door knobs.

In accordance with these and other objects which will become apparent hereinafter, the instant invention will now be described with reference to the accompanying drawings in which:

DESCRIPTION OF THE PREFERRED EMBODIMENT

Figure 2:
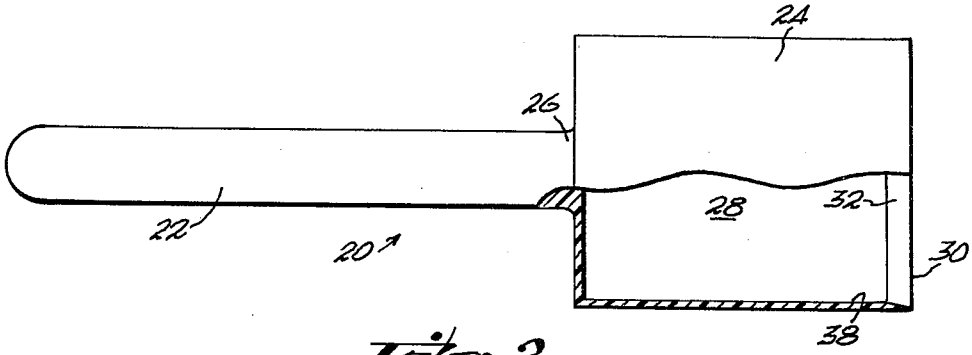
FIG. 2 is a view partly broken away and illustrating the details of the invention.
Figure 3:
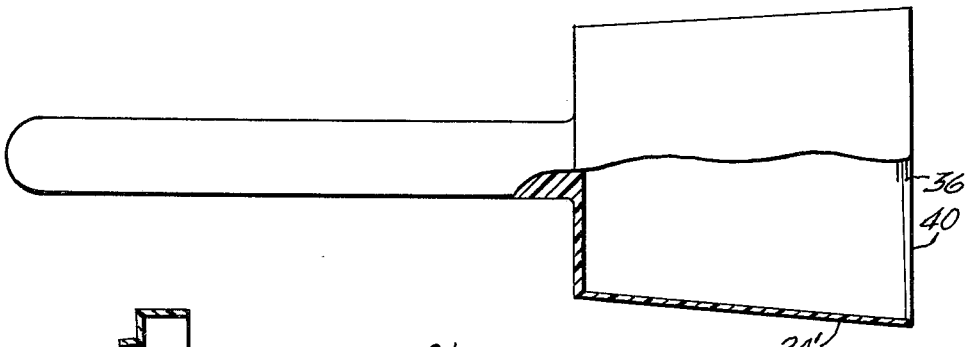
FIG. 3 is a view similar to FIG. 2 and illustrating the insert shown in FIG. 2 removed from the leading or working end of the tool.
Figure 4:
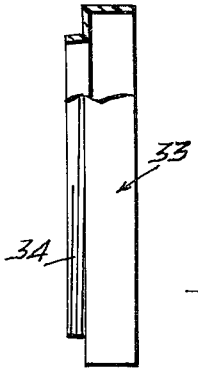
FIG. 4 is a view partly in cross section showing the insert which has been removed from FIG. 2.

Referring to the drawings wherein like reference characters designate like or corresponding parts throughout the several views, the numeral 12 generally designates a portion of a door adjacent a door knob generally designated by the numeral 14 having a base or flange 16 which is secured to the door in a conventional fashion. The door knob shield is generally designated by the numeral 20. It is seen to include a handle 22 and a skirt 24 at the forward end 26. The skirt defines a chamber 28, see FIG. 2. The chamber is open at the distal end 30 and may be beveled as at 32. Alternatively, as best seen in FIG. 4, an insert 33 having an annular portion with a threaded nose 34, sized for threaded engagement with internal threads 36 at the mouth of the skirt 24 of the modified form of the device of FIG. 3. Conventionally, one or two turns is all that is required to remove or install the insert. The insert may be of two or three sizes for the purpose now to be described.

Figure 1:
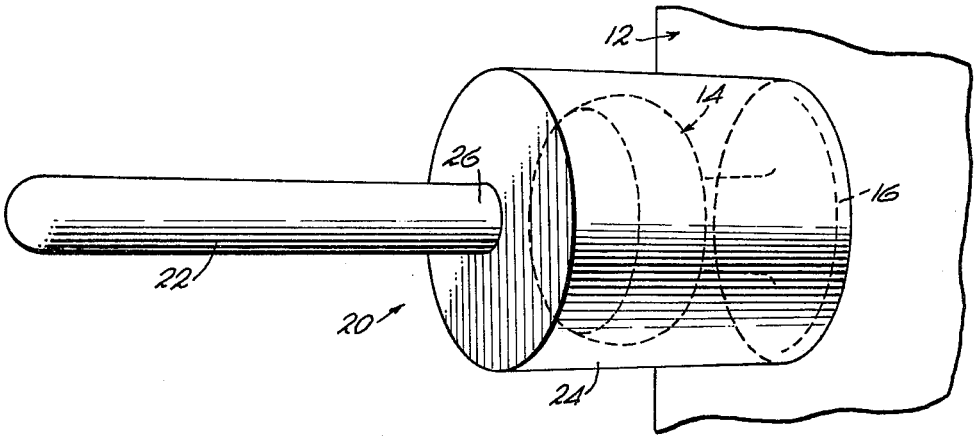
FIG. 1 is a view illustrating the use of the instant invention.

In use, as shown in FIG. 1, the skirt is positioned with the interior wall 38 in close abutting relation to the flange 16 of the door knob and with the knob 14 within the chamber 28 of the skirt. As the handle is grasped, and the shield is in the position shown, the door may be painted quickly and easily, either by a brush or spray about the flange without getting paint on the metal of the door knob. For different size door knobs, an insert, see FIG. 4, may be threadably engaged in the mouth or end 40, FIG. 3, by engaging the exterior threads 34 of the insert with the internal threads 36 of the skirt. Depending upon the size of the flange of a door knob, an insert as shown in FIG. 4 is selected.

It is thus seen that there has been provided a simple and inexpensive tool for use by painters in shielding a door knob so that the door surface adjacent the door knob when installed may be quickly and easily painted in a smooth clean job which does not require expensive masking tape and other time-consuming procedures.

In accordance with the foregoing, it will be appreciated that while the instant invention has been shown and described in what is considered to be a practical and preferred embodiment, departures may be made therefrom within the spirit and scope of this invention which is, therefore, not to be limited except as set forth hereinafter.

What is claimed is:

1. A door knob shield comprising an elongate handle having a first end and a second end, a skirt having a closed end and an open end and means securing the closed end in coaxial relation with the handle, said skirt being sized for nestingly recieving the door knob and said open end of said skirt being sized to abutt the surface of a door adjacent a door knob, said skirt is in internal threaded adjacent said open end and an annular ring is provided in threaded engagement with said skirt, said ring being inserted within said skirt and adapted to accommodate the door knob, where different sized rings can be individually attached to the threaded end of the skirt to accommodate different sized door knob bases.

2. The device as set forth in claim 1 wherein said device is of plastic material.

* * * * *